US012392530B2

(12) United States Patent
Kopko

(10) Patent No.: US 12,392,530 B2
(45) Date of Patent: Aug. 19, 2025

(54) CHILLER SYSTEM WITH MULTIPLE COMPRESSORS

(71) Applicant: Johnson Controls Tyco IP Holdings LLP, Milwaukee, WI (US)

(72) Inventor: William Leslie Kopko, Jacobus, PA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 419 days.

(21) Appl. No.: 17/626,792

(22) PCT Filed: Jul. 14, 2020

(86) PCT No.: PCT/US2020/041972

§ 371 (c)(1),
(2) Date: Jan. 12, 2022

(87) PCT Pub. No.: WO2021/011562

PCT Pub. Date: Jan. 21, 2021

(65) Prior Publication Data

US 2022/0333834 A1 Oct. 20, 2022

Related U.S. Application Data

(60) Provisional application No. 62/874,394, filed on Jul. 15, 2019.

(51) Int. Cl.
*F25B 39/02* (2006.01)
*F25B 5/04* (2006.01)
(Continued)

(52) U.S. Cl.
CPC ..... *F25B 39/02* (2013.01); *F25B 5/04* (2013.01); *F25B 6/04* (2013.01); *F25B 41/39* (2021.01);
(Continued)

(58) Field of Classification Search
CPC ..... F28D 2021/0071; F28D 2021/007; F28D 7/163; F28D 7/0075; F25B 2400/23;
(Continued)

(56) References Cited

U.S. PATENT DOCUMENTS 2,206,428 A * 7/1940 Reavis ..... F25B 1/08 62/170
2,682,756 A * 7/1954 Clark ..... F25B 5/00 62/502
(Continued)

FOREIGN PATENT DOCUMENTS

CN 105135729 A 12/2015
CN 107687716 A 2/2018
(Continued)

OTHER PUBLICATIONS

PCT International Search Report and Written Opinion for PCT Application No. PCT/US2020/041972, mailed Oct. 16, 2020, 14 pgs.
(Continued)

*Primary Examiner* — Travis Ruby
(74) *Attorney, Agent, or Firm* — Fletcher Yoder, P.C.

(57) ABSTRACT

A heating, ventilation, air conditioning, and/or refrigeration (HVAC&R) system includes a first vapor compression flow path having a first condenser configured to place a working fluid in a heat exchange relationship with a cooling fluid, a second vapor compression flow path having a first evaporator configured to place the working fluid in a heat exchange relationship with a conditioning fluid, and a shared vapor compression flow path having a second condenser configured to place the working fluid in a heat exchange relationship with the cooling fluid and a second evaporator configured to place the working fluid in a heat exchange relationship with the conditioning fluid. The first vapor compression flow path is configured to direct working fluid
(Continued)

vapor from the second evaporator to the first condenser and the second vapor compression flow path is configured to direct working fluid liquid from the second evaporator to the first evaporator.

20 Claims, 10 Drawing Sheets

(51) Int. Cl.

| | |
|---|---|
| ***F25B 6/04*** | (2006.01) |
| ***F25B 41/39*** | (2021.01) |
| ***F28D 7/00*** | (2006.01) |
| ***F28D 7/16*** | (2006.01) |
| *F28D 21/00* | (2006.01) |

(52) U.S. Cl.
CPC ..... *F28D 7/0075* (2013.01); *F28D 7/163* (2013.01); *F25B 2339/0242* (2013.01); *F25B 2400/0403* (2013.01); *F25B 2400/0409* (2013.01); *F25B 2400/0411* (2013.01); *F25B 2400/075* (2013.01); *F25B 2400/13* (2013.01); *F25B 2400/23* (2013.01); *F28D 2021/007* (2013.01); *F28D 2021/0071* (2013.01)

(58) Field of Classification Search
CPC ..... F25B 2400/13; F25B 2400/075; F25B 2400/0411; F25B 2400/0409; F25B 2400/0403; F25B 2339/0242; F25B 6/04; F25B 5/04; F25B 41/39; F25B 39/02
See application file for complete search history.

(56) References Cited

U.S. PATENT DOCUMENTS

| | | | | | |
|---|---|---|---|---|---|
| 2,720,083 | A * | 10/1955 | Garland | A23C 3/033 | 62/122 |
| 3,675,441 | A * | 7/1972 | Perez | F25D 21/06 | 62/434 |
| 4,474,026 | A * | 10/1984 | Mochizuki | F25B 47/022 | 62/157 |
| 4,487,028 | A * | 12/1984 | Foye | F25D 17/02 | 165/218 |
| 4,528,823 | A * | 7/1985 | Mochizuki | F25B 1/00 | 62/335 |
| 5,235,820 | A * | 8/1993 | Radermacher | F25B 6/00 | 62/502 |
| 5,410,889 | A * | 5/1995 | Sjoholm | F25B 49/02 | 62/196.2 |
| 6,047,556 | A * | 4/2000 | Lifson | F25B 40/02 | 62/196.2 |
| 6,058,727 | A * | 5/2000 | Fraser, Jr. | F25B 43/006 | 62/190 |
| 6,202,438 | B1 * | 3/2001 | Barito | F25B 1/04 | 62/505 |
| 7,270,278 | B2 * | 9/2007 | Street | F25B 49/022 | 236/94 |
| 8,739,562 | B2 | 6/2014 | Kohler et al. | | |
| 9,212,836 | B2 | 12/2015 | Welch | | |
| 2002/0066278 | A1 * | 6/2002 | Cho | F25B 9/006 | 62/512 |
| 2006/0225451 | A1 * | 10/2006 | Hu | F25B 30/02 | 62/324.1 |
| 2012/0111040 | A1 | 5/2012 | Kohler et al. | | |
| 2014/0216068 | A1 * | 8/2014 | Lee | F25B 43/003 | 62/126 |
| 2018/0216851 | A1 * | 8/2018 | Christensen | F25B 5/00 | |

FOREIGN PATENT DOCUMENTS

| | | | |
|---|---|---|---|
| EP | 1712854 | A2 | 10/2006 |
| JP | 2013134043 | A | 7/2013 |
| KR | 20080065186 | A | 7/2008 |
| KR | 20130090224 | A | 8/2013 |
| WO | 2017023632 | A1 | 2/2017 |

OTHER PUBLICATIONS

Chinese Office Action for CN Application No. 202080043401.9, dated Aug. 24, 2022, 12 pgs.
Korean Office Action for KR Application No. 10-2022-7004674, dated Dec. 21, 2023, 8 pgs.

* cited by examiner

CHILLER SYSTEM WITH MULTIPLE COMPRESSORS

CROSS REFERENCE TO RELATED APPLICATION

This application is a U.S. National Stage Application of PCT International Application No. PCT/US2020/041972, entitled "CHILLER SYSTEM WITH MULTIPLE COMPRESSORS." filed Jul. 14, 2020, which claims priority from to and the benefit of U.S. Provisional Application Ser. No. 62/874,394, entitled "CHILLER SYSTEM WITH MULTIPLE COMPRESSORS," filed Jul. 15, 2019, each of which is hereby incorporated by reference in its entirety for all purposes.

BACKGROUND

This section is intended to introduce the reader to various aspects of art that may be related to various aspects of the present disclosure, and are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the vapor compression system. The chiller system may direct the working fluid through a heat exchanger configured to place the working fluid in a heat exchange relationship with a conditioning fluid, such as to remove thermal energy (e.g., heat) from the conditioning fluid. The chiller system may then deliver the conditioning fluid to conditioning equipment and/or an environment conditioned by the chiller system. In some cases, the chiller system may include multiple vapor compression systems that may operate in a series flow arrangement with the conditioning fluid to increase a capacity of the chiller system. In some cases, respective working fluids of each vapor compression system are directed through the respective components of the corresponding vapor compression system to enable each vapor compression system to operate independently from one another. As such, each vapor compression system may be activated or deactivated based on a target capacity of the chiller system. However, in some circumstances, this arrangement of multiple vapor compression systems may limit an effectiveness or an efficiency of the chiller system.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, air conditioning, and/or refrigeration (HVAC&R) system includes a first vapor compression flow path having a first condenser configured to place a working fluid in a heat exchange relationship with a cooling fluid, a second vapor compression flow path having a first evaporator configured to place the working fluid in a heat exchange relationship with a conditioning fluid, and a shared vapor compression flow path having a second condenser configured to place the working fluid in a heat exchange relationship with the cooling fluid and a second evaporator configured to place the working fluid in a heat exchange relationship with the conditioning fluid. The first vapor compression flow path is configured to direct working fluid vapor from the second evaporator to the first condenser and the second vapor compression flow path is configured to direct working fluid liquid from the second evaporator to the first evaporator.

In another embodiment, a heating, ventilation, air conditioning, and/or refrigeration (HVAC&R) system includes a first vapor compression flow path having a first condenser configured to place a first portion of a working fluid in thermal communication with a cooling fluid, a first evaporator configured to place the first portion of the working fluid in thermal communication with a conditioning fluid, and a first compressor configured to direct the first portion of the working fluid from the first evaporator to the first condenser. The HVAC&R system also includes a second vapor compression flow path having a second compressor configured to direct a second portion of the working fluid from a second evaporator to a second condenser, and the HVAC&R system further includes a shared vapor compression flow path having the second condenser and the second evaporator. The second condenser is configured to receive the first portion of the working fluid from the first condenser of the first vapor compression flow path and receive the second portion of the working fluid from the second evaporator, in which the shared vapor compression flow path is configured to direct the first portion of the working fluid and the second portion of the working fluid from the second condenser to the second evaporator.

In another embodiment, a heating, ventilation, air conditioning, and/or refrigeration (HVAC&R) system includes a first vapor compression flow path having a first condenser configured to place a first portion of a working fluid in thermal communication with a cooling fluid, a first evaporator configured to place the first portion of the working fluid in thermal communication with a conditioning fluid, and a first compressor configured to direct the first portion of the working fluid from the first evaporator to the first condenser. The HVAC&R system also includes a shared vapor compression flow path having a second condenser configured to place a second portion of the working fluid in thermal communication with the cooling fluid and a second evaporator configured to place the second portion of the working fluid in thermal communication with the conditioning fluid. The shared vapor compression flow path is configured to direct the second portion of the working fluid from the second condenser to the second evaporator. The HVAC&R system further includes a second vapor compression flow path having a second compressor configured to direct a third portion of the working fluid from the second evaporator to the second condenser and a bypass conduit system configured to direct the first portion of the working fluid from the first condenser to the first evaporator, such that the first portion of the working fluid bypasses the second condenser and the second evaporator.

DRAWINGS

Various aspects of this disclosure may be better understood upon reading the following detailed description and upon reference to the drawings in which.

Figure 5:
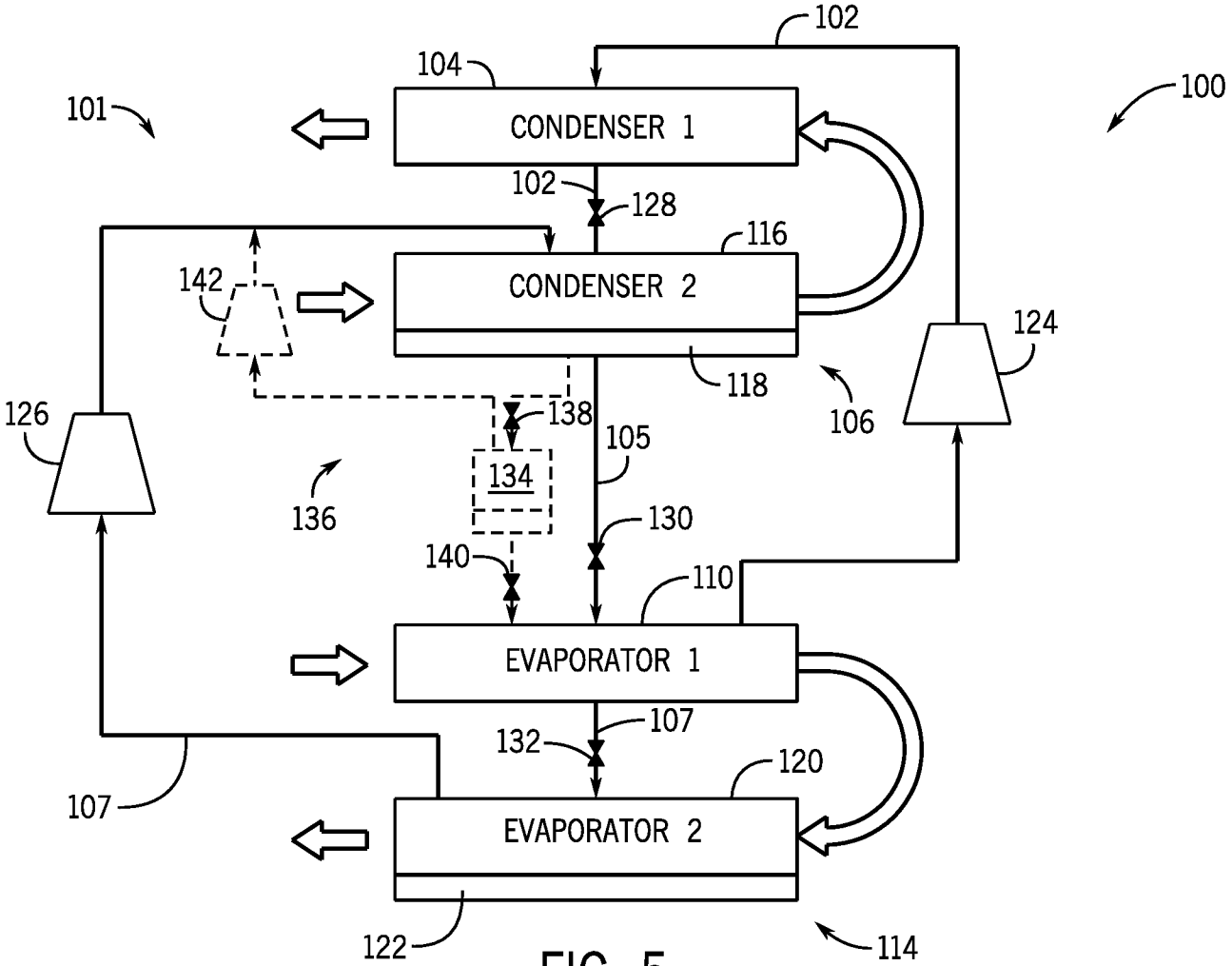
FIG. 5 is a schematic view of an embodiment of an HVAC&R system having multiple vapor compression circuits, in accordance with an aspect of the present disclosure.
Figure 7:
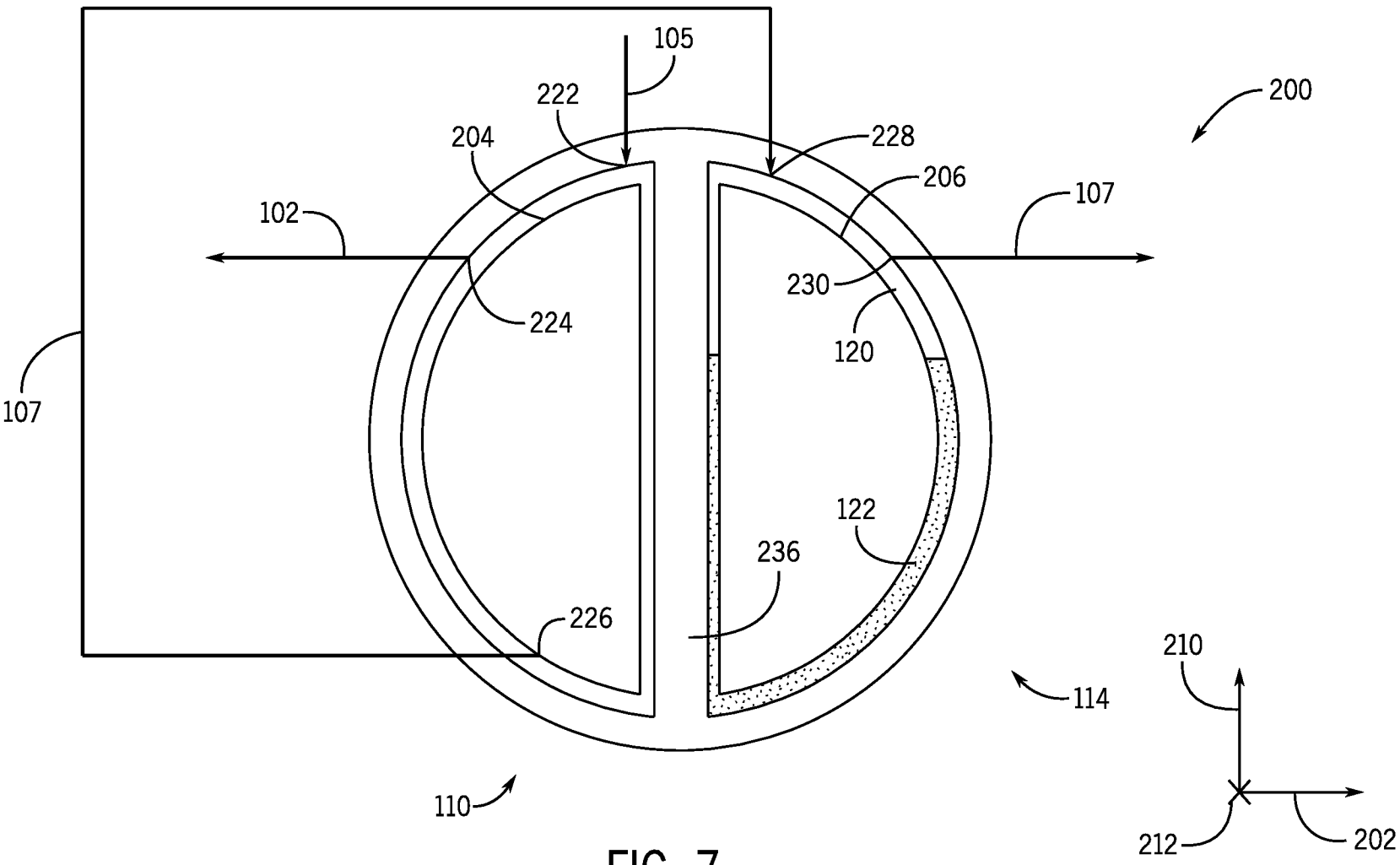
FIG. 7 is a cross-section of an embodiment of a shell of a heat exchanger within a common vapor compression circuit of an HVAC&R system, in accordance with an aspect of the present disclosure.
Figure 8:
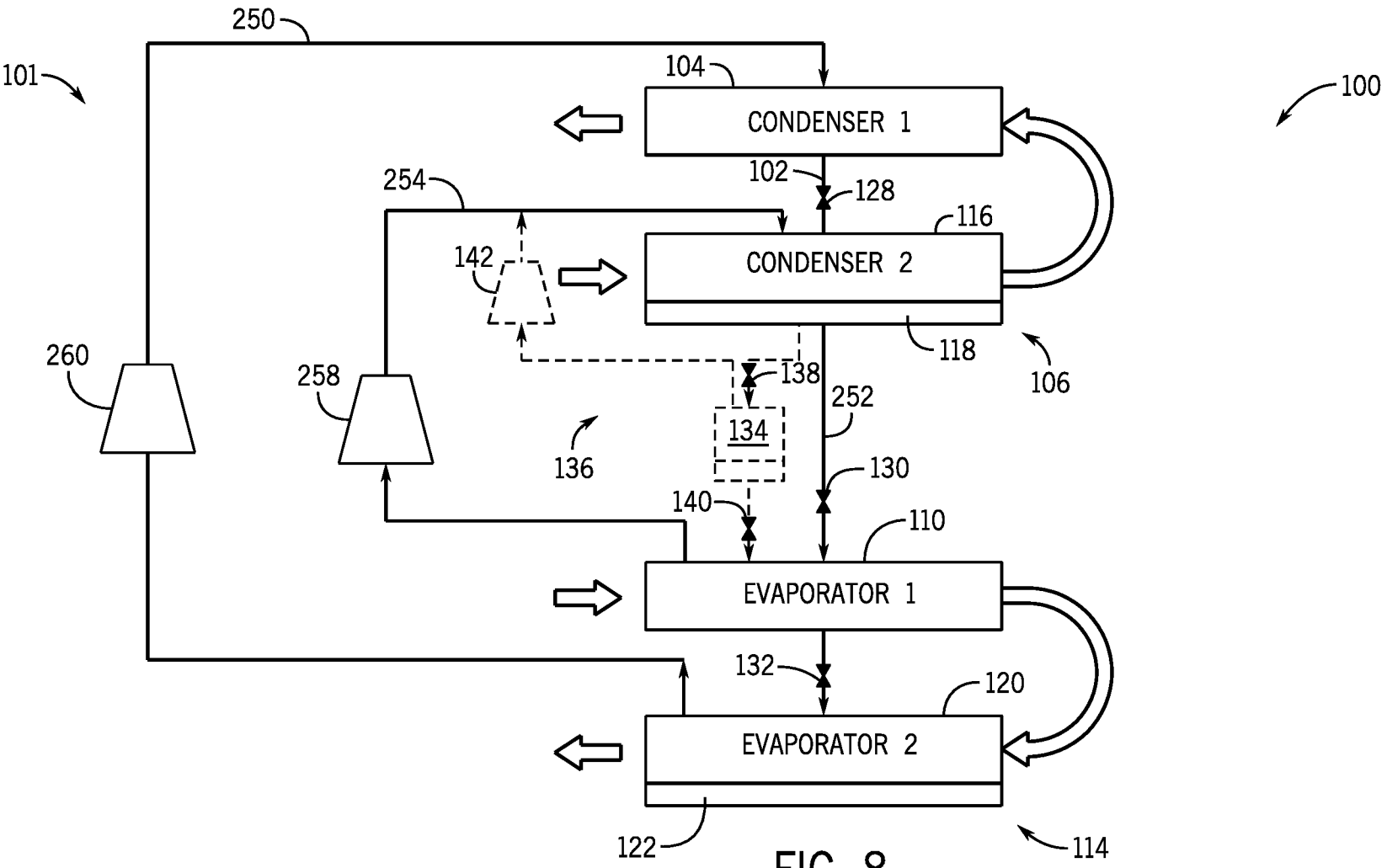
FIG. 8 is a schematic view of another embodiment of an HVAC&R system having multiple vapor compression circuits, in accordance with an aspect of the present disclosure.
Figure 9:
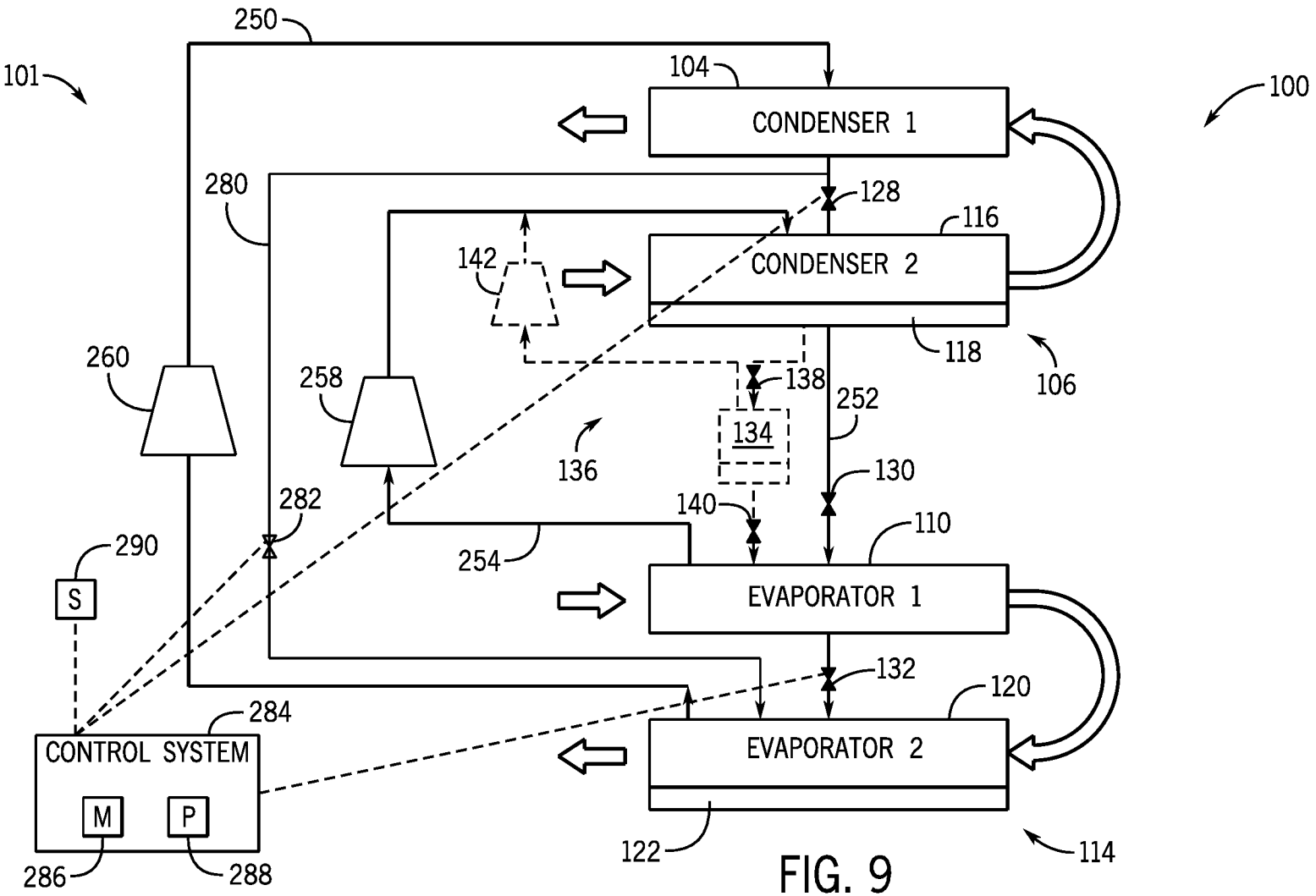
Figure 10:
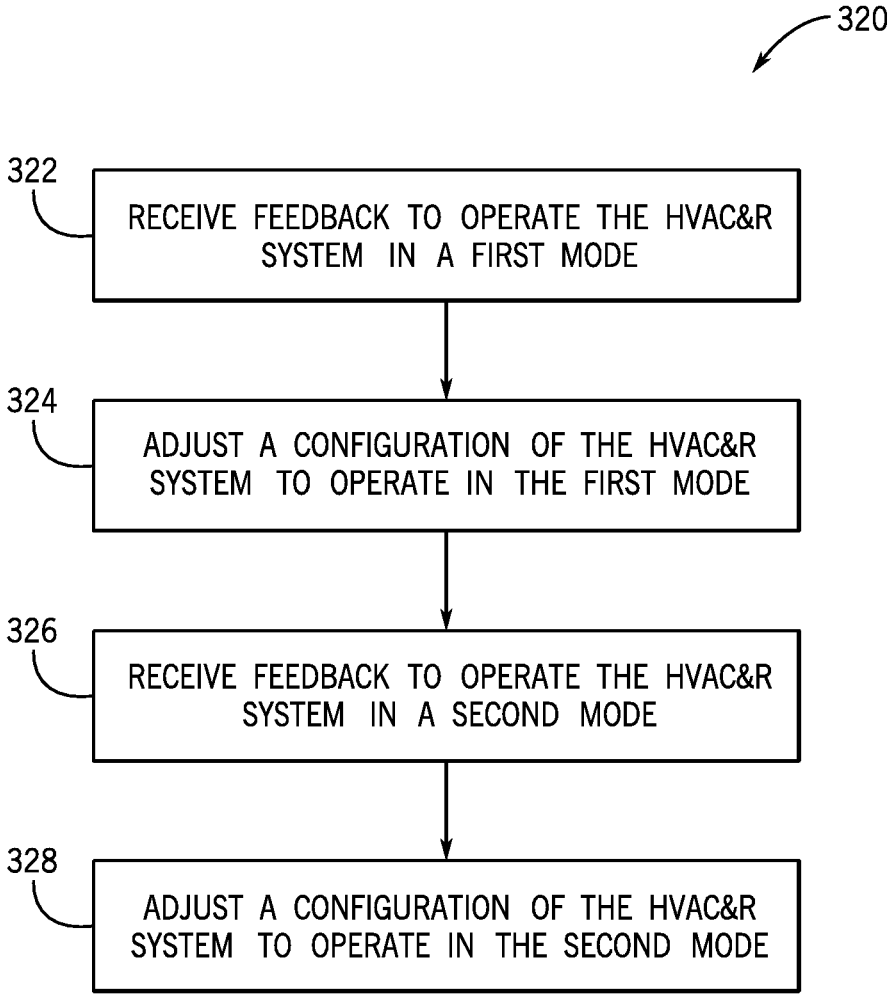

FIG. 9 is a schematic view of another embodiment of an HVAC&R system having multiple vapor compression circuits and a bypass conduit assembly that enables the multiple vapor compression circuits to operate independently of one another, in accordance with an aspect of the present disclosure; and FIG. 10 is a block diagram illustrating an embodiment of a method for adjusting operation of the HVAC&R system of FIGS. 5, 7, and 8, in accordance with an aspect of the present disclosure.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure relate to an HVAC&R system having multiple vapor compression circuits, such as a first vapor compression circuit (e.g., a high pressure vapor compression circuit), a second vapor compression circuit (e.g., a low pressure vapor compression circuit), and a shared or common vapor compression circuit (e.g., a mixed high pressure and low pressure vapor compression circuit). As used herein, a vapor compression circuit (e.g., a vapor compression flow path) includes components, such as conduits, piping, tubing, valves, pumps, and so forth that direct a working fluid through a portion of the HVAC&R system. In some embodiments, the vapor compression circuit may not define a complete loop. The first and second vapor compression circuits may each include a condenser configured to place a working fluid in thermal communication with a cooling fluid and an evaporator configured to place respective the working fluids in thermal communication with a conditioning fluid. Including multiple vapor compression circuits may generally increase a capacity of the HVAC&R system to absorb heat from the conditioning fluid as compared to an HVAC&R system having a single vapor compression circuit. For example, the conditioning fluid may be directed through and cooled by multiple heat exchangers (e.g., evaporators) instead of by a single heat exchanger. In existing HVAC&R systems, vaporous working fluid and liquid working fluid may mix with one another in certain portions of a given vapor compression system, and may limit an efficiency of the HVAC&R system generally.

In accordance with embodiments of the present disclosure, an HVAC&R system may combine working fluid from the first vapor compression circuit and the second vapor compression circuit into the common vapor compression circuit to increase an efficiency of the HVAC&R system. Further, in some embodiments, the HVAC&R system may include components (e.g., valves) that enable each of the vapor compression circuits to operate independently from one another, such that the respective working fluids of the vapor compression systems may be fluidly separate from one another. In other words, the components (e.g., valves) may enable the HVAC&R system to operate without directing a mixture of working fluids from the first vapor compression circuit and the second vapor compression circuit through the common vapor compression circuit.

Under some operating conditions, enabling the respective working fluids of the multiple vapor compression circuits to combine with one another in the common vapor compression circuit may reduce an amount of mixed vapor and liquid working fluid within various locations of the vapor compression circuits, and thereby improve an efficiency of the HVAC&R system. For example, combining the respective working fluids of the multiple vapor compression circuits within a condenser of the second vapor compression circuit (e.g., a low pressure condenser) and/or an evaporator of the first vapor compression circuit (e.g., a high pressure evaporator) may reduce an amount of working fluid vapor within the evaporator of the first vapor compression circuit, thereby increasing an amount of thermal energy that the working fluid within the evaporator of the first vapor compression circuit may absorb from the conditioning fluid. Further, working fluid liquid that evaporates within the evaporator of the first vapor compression circuit may be drawn toward a condenser (e.g., of the first vapor compression circuit) via a first compressor, and any remaining liquid working fluid within the evaporator of the first vapor compression circuit may be directed toward an evaporator (e.g., of the second vapor compression circuit) to further absorb thermal energy from the conditioning fluid. Thus, the cooling capacity of the working fluids in both evaporators of the first vapor compression circuit and the second vapor compression circuit may be improved, and an overall performance of the HVAC&R system to cool the conditioning fluid may be increased.

Figure 1:
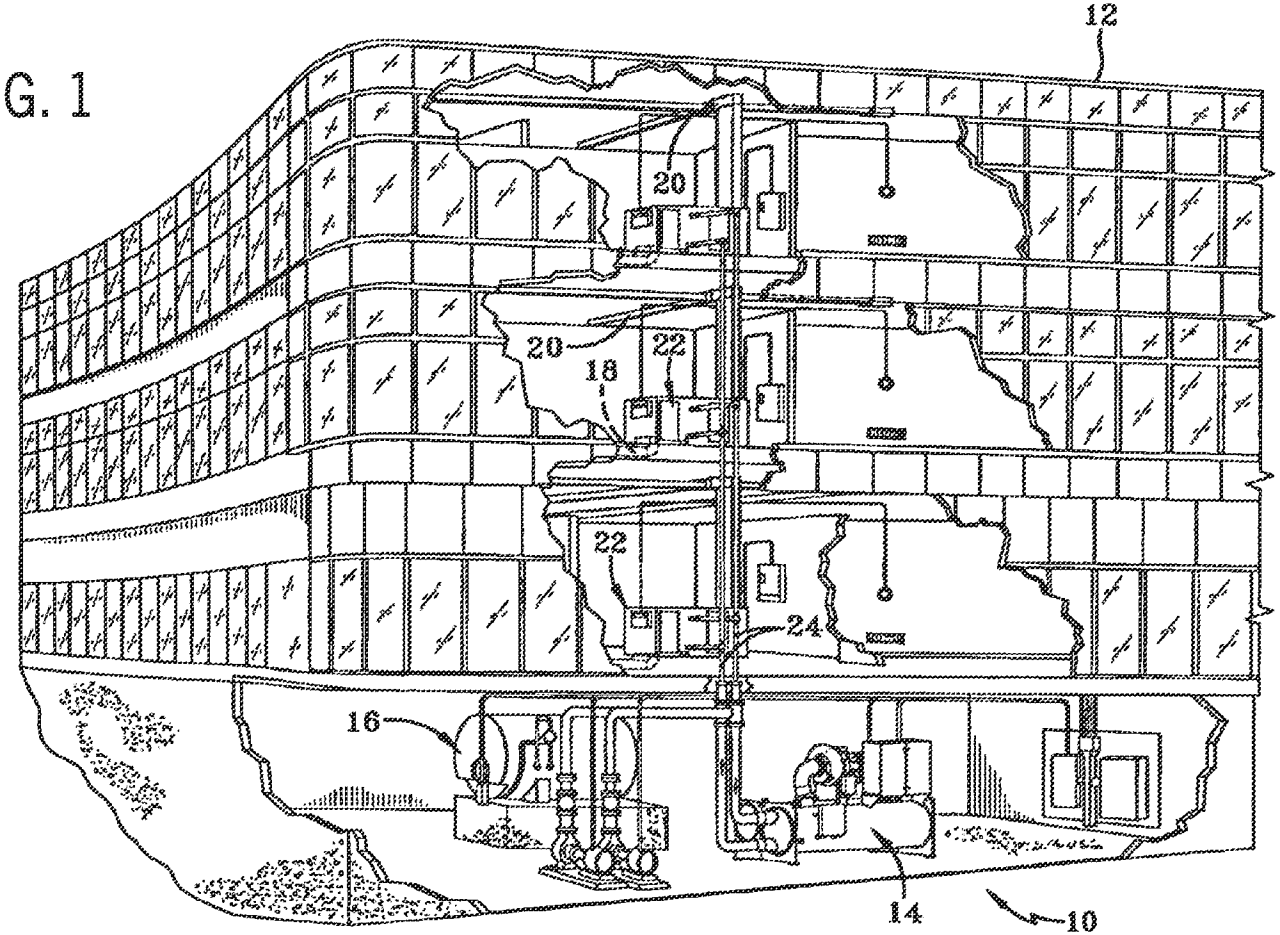
FIG. 1 is a perspective view of a building that may utilize an embodiment of a heating, ventilation, air conditioning, and/or refrigeration (HVAC&R) system in a commercial setting, in accordance with an aspect of the present disclosure.

Turning now to the drawings, FIG. 1 is a perspective view of an embodiment of an environment for a heating, ventilation, and air conditioning (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system that circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
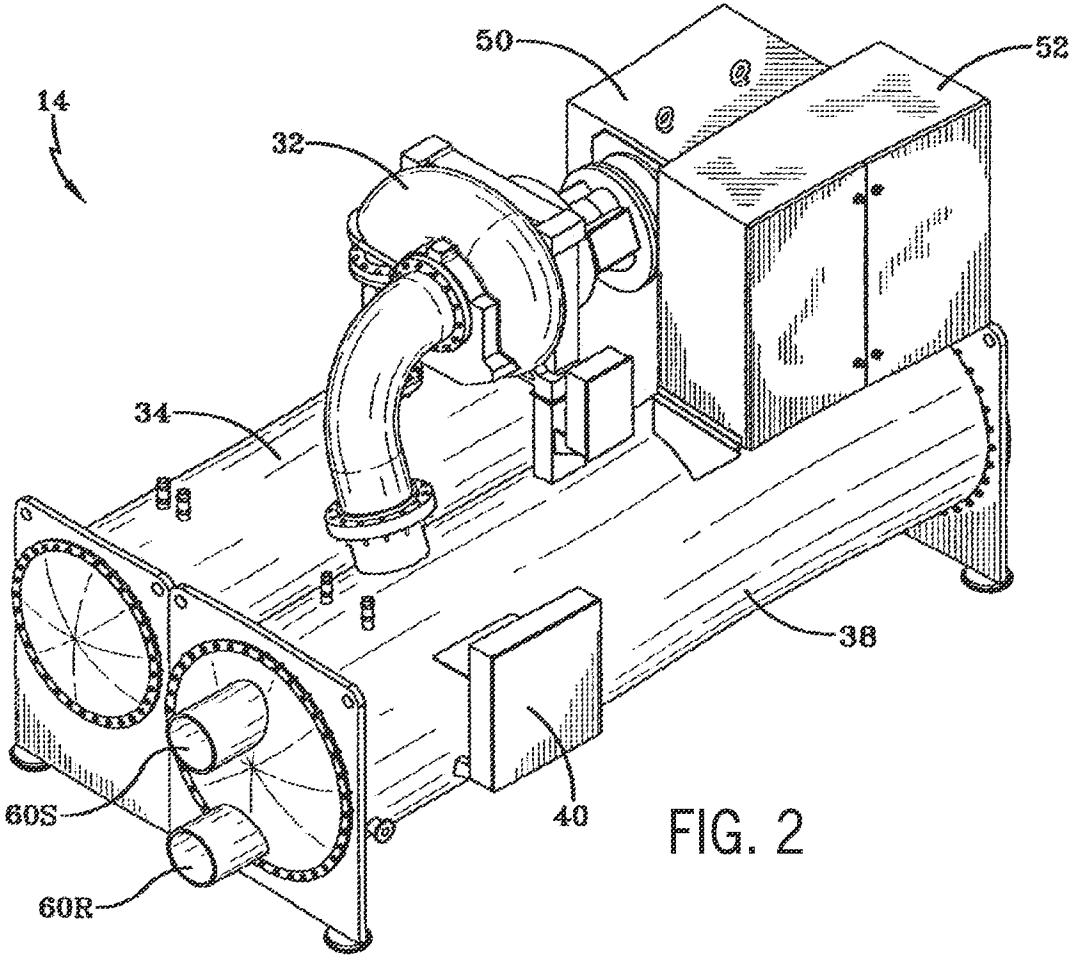
FIG. 2 is a perspective view of an embodiment of a vapor compression system, in accordance with an aspect of the present disclosure.
Figure 3:
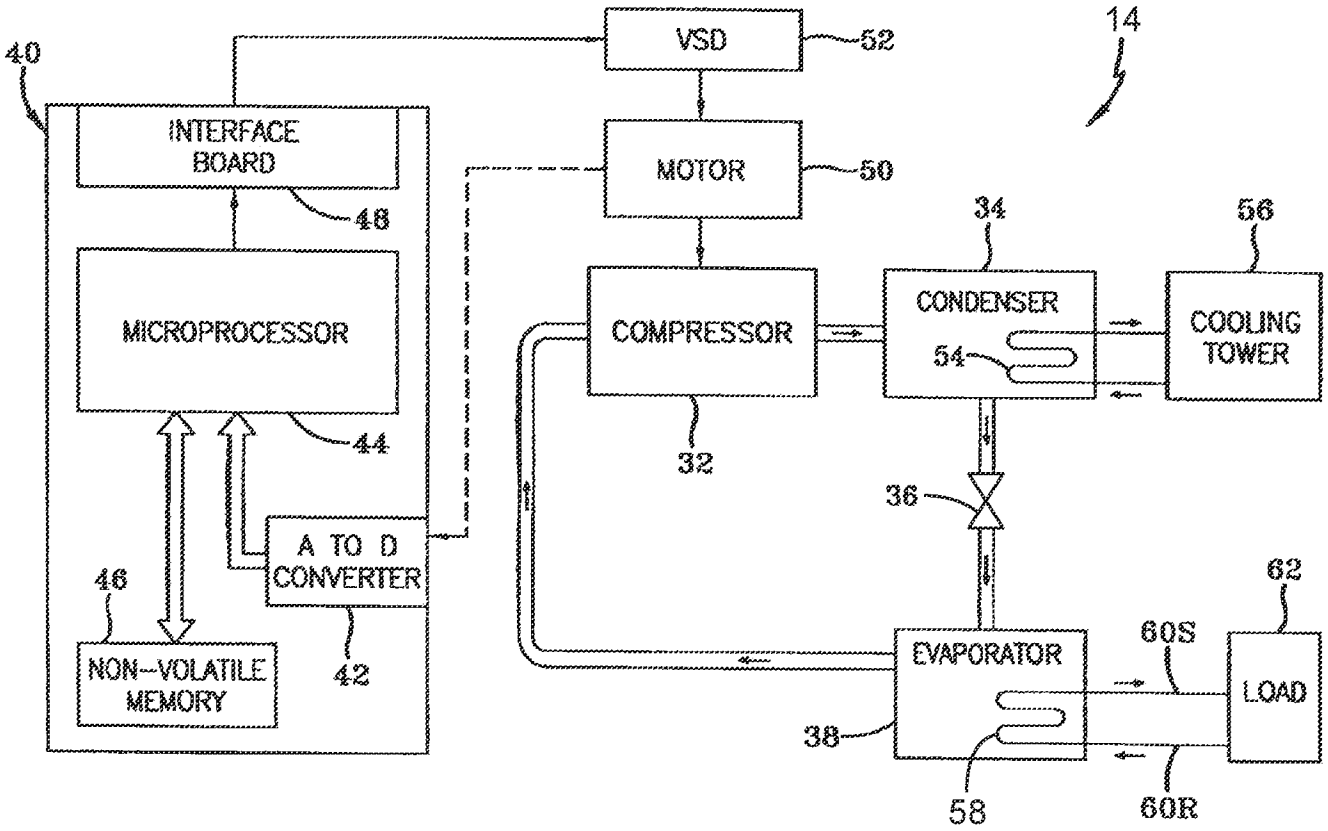
FIG. 3 is a schematic view of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon based refrigerants, water vapor, refrigerants with low global warming potential (GWP), or any other suitable refrigerant. In some embodiments, the vapor compression system 14 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. In certain embodiments, the supply line 60S and/or the return line 60R may include a pump or another suitable device to circulate the cooling fluid. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
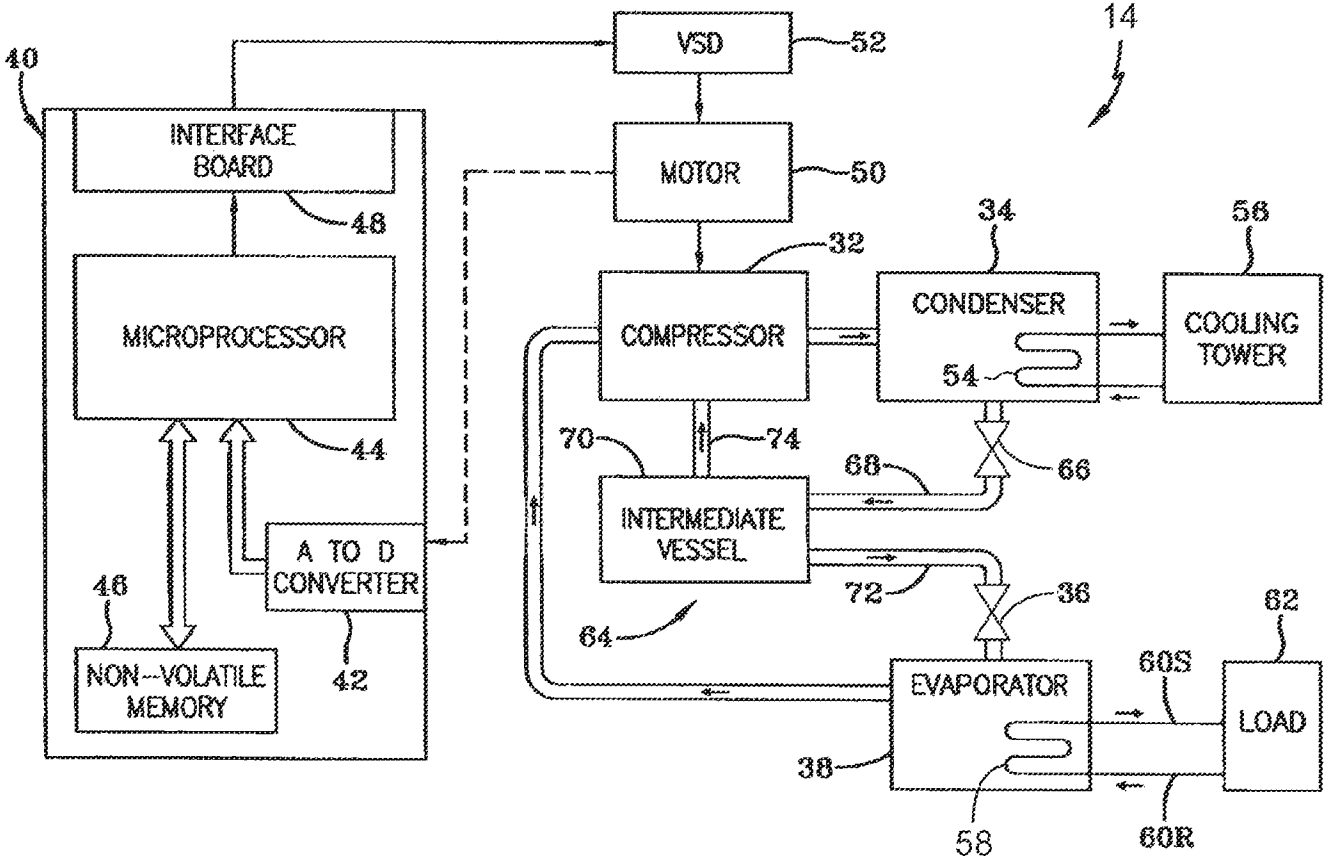
FIG. 4 is a schematic view of another embodiment of the vapor compression system of FIG. 2, in accordance with an aspect of the present disclosure.

FIG. 4 is a schematic view of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through an economizer suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

In certain embodiments, an HVAC&R system may include multiple vapor compression circuits, such as combinations of a vapor-compression system 14, to increase a cooling capacity of the HVAC&R system. For example, the HVAC&R system may direct a working fluid through a first vapor compression circuit (e.g., a high pressure vapor compression circuit), a second vapor compression circuit (e.g., a low pressure vapor compression circuit), and/or a shared or common vapor compression circuit. In some embodiments, the first vapor compression circuit includes a first condenser that places a working fluid in thermal communication with a cooling fluid to cool the working fluid. Additionally, the second vapor compression circuit and/or the shared vapor compression circuit may include a second condenser that also places the working fluid in thermal communication with the cooling fluid. The HVAC&R system may also direct the working fluid through a first evaporator of the shared vapor compression circuit and through a second evaporator of the second vapor compression circuit, in which the working fluid is placed in thermal communication with a conditioning fluid in each of the evaporators to cool the conditioning fluid. Generally, the cooling capacity of the working fluid is increased when the working fluid enters the evaporators is in a liquid state as compared to a gaseous or vaporous state. However, working fluid vapor may be produced at certain sections of the HVAC&R system, such as within the evaporators of the HVAC&R system, and may therefore limit the cooling capacity of the working fluid. As such, in accordance with embodiments of the present disclosure, the HVAC&R system may be configured to separate the working fluid vapor from the working fluid liquid to remove the working fluid vapor from certain locations within the HVAC&R system to increase the cooling capacity of the working fluid.

FIG. 5 is a schematic view an embodiment of an HVAC&R system 100 having multiple vapor compression circuits. The HVAC&R system 100 may have a conduit system 101 configured to direct a working fluid through the vapor compression circuits. For instance, the conduit system 101 may direct the working fluid through a first vapor compression circuit 102 configured to direct the working fluid through a first condenser 104, in which the working fluid is placed in a heat exchange relationship, or in thermal communication with, a cooling fluid. Additionally, the conduit system 101 may direct the working fluid through a shared vapor compression circuit 105, where working fluid from the first condenser 104 mixes with working fluid from a second vapor compression circuit 107 in a second condenser 106. The second condenser 106 may place the combined working fluid in thermal communication with the cooling fluid to further cool the working fluid. In some embodiments, the cooling fluid may be directed from the second condenser 106 to the first condenser 104 in a series flow arrangement to remove thermal energy (e.g., heat) from the working fluid in each of the condensers 104, 106. Additionally, the shared vapor compression circuit 105 may direct the combined working fluid from the second condenser 106 to a first evaporator 110. In the first evaporator 110, vaporous working fluid may be removed and returned to the first condenser 104 via the first vapor compression circuit 102. Further, the second vapor compression circuit 107 is configured to receive and direct the working fluid from the first evaporator 110 to a second evaporator 114 and from the second evaporator 114 to the second condenser 106. The working fluid may be placed in a heat exchange relationship, or in thermal communication, with a conditioning fluid in each of the evaporators 110, 114. As an example, the conditioning fluid may be directed from the first evaporator 110 to the second evaporator 114 in a series flow arrangement, in which the working fluid may remove thermal energy from the conditioning fluid in each of the evaporators 110, 114.

By directing the working fluid through multiple condensers 104, 106 and multiple evaporators 110, 114, the HVAC&R system 100 may cool the conditioning fluid more effectively or efficiently as compared to directing the working fluid through a single condenser and/or evaporator. By way of example, an initial amount of thermal energy may be removed from the conditioning fluid in the first evaporator 110 to cool the conditioning fluid, and an additional amount of thermal energy may be removed from the conditioning fluid in the second evaporator 114 to further cool the conditioning fluid. In addition, directing the working fluid through the first condenser 104 may enable an initial amount of thermal energy to be removed from the working fluid, and directing the working fluid through the second condenser 106 may enable an additional amount of thermal energy to be removed from the working fluid. As such, the working fluid exiting the second condenser 106 may be in a liquid state and/or a subcooled state, such that the cooling capacity of the working fluid is increased.

In certain embodiments, at least one of the condensers 104, 106 may include a subcooler. For example, the second condenser 106 may include a condensing section 116 and a condenser subcooler 118 that may each receive a portion of the cooling fluid directed into the second condenser 106. In some embodiments, the condensing section 116 and the condenser subcooler 118 may each receive substantially the same flow rate (e.g., volumetric flow rate) of cooling fluid. In other embodiments, the condensing section 116 may receive a different flow rate (e.g., 25% more or 25% less) of cooling fluid than the condenser subcooler 118. As such, a first amount of thermal energy may be removed from the working fluid in the condensing section 116, and a second amount of thermal energy may be removed from the working fluid in the condenser subcooler 118 to further cool the working fluid. Although FIG. 5 illustrates the second condenser 106 having the condenser subcooler 118, the first condenser 104 may additionally or alternatively include a subcooler.

Furthermore, at least one of the evaporators 110, 114 may include a flooded section where liquid working fluid may accumulate and absorb thermal energy from the conditioning fluid. For example, the second evaporator 114 may include a vapor section 120 that includes working fluid vapor that has evaporated (e.g., as a result of heat transfer between the working fluid and the conditioning fluid). The second evaporator 114 may further include a flooded section 122 that accumulates working fluid liquid that has not been evaporated, such that the working fluid liquid may further absorb thermal energy from the conditioning fluid flowing through the second evaporator 114. In some embodiments, the first evaporator 110 may additionally or alternatively have a flooded section, which may contain working fluid liquid that is directed from the first evaporator 110 to the second evaporator 114.

In some embodiments, the first vapor compression circuit 102 and the second vapor compression circuit 107 may each include compressors configured to increase a pressure of the respective working fluid flowing through the first and second vapor compression circuits 102, 107. For example, a first compressor 124 may be fluidly coupled to the first vapor compression circuit 102, in which the first compressor 124 is configured to compress working fluid vapor received from the first evaporator 110 and direct the compressed working fluid to the first condenser 104 via the first vapor compression circuit 102. A second compressor 126 may be fluidly coupled to the second vapor compression circuit 107, in which the second compressor 126 is configured to compress working fluid vapor received from the second evaporator 114 and direct the compressed working fluid to the second condenser 106 via the second vapor compression circuit 107. Compressing the working fluid with the compressors 124, 126 may increase a temperature of the respective working fluid flows through the first and second vapor compression circuits 102, 107. As such, the working fluid is directed toward the respective condensers 104, 106 from the compressors 124, 126, where the cooling fluid may remove thermal energy from the working fluid.

In certain embodiments, the HVAC&R system 100 may also include a plurality of expansion valves configured to decrease a pressure of the working fluid. For example, the first vapor compression circuit 102 may include a first expansion valve or device 128 positioned between the first condenser 104 and the second condenser 106 and may be configured to expand the working fluid flowing from the first condenser 104 to the second condenser 106. Thus, the pressure of the combined working fluid in the second condenser 106 may be less than the pressure of the working fluid in the first condenser 104, such that the first condenser 104 may be considered a high pressure condenser and the second condenser may be considered a low pressure condenser. The shared vapor compression circuit 105 may include a second expansion valve 130 positioned between the second condenser 106 and the first evaporator 110 and may be configured to expand the combined working fluid flowing from the second condenser 106 to the first evaporator 110. In this manner, the pressure of the working fluid in the first evaporator 110 may be less than the pressure of the working fluid in the second condenser 106, and may further reduce a temperature of the working fluid to reduce an amount of working fluid vapor entering the first evaporator 110. The second vapor compression circuit 107 may include a third expansion valve 132 positioned between the first evaporator 110 and the second evaporator 114 and may be configured to expand the working fluid flowing from the first evaporator 110 to the second evaporator 114. As such, the pressure of the working fluid in the second evaporator 114 may be less than the pressure of the working fluid in the first evaporator 110, such that the first evaporator 110 may be considered a high pressure evaporator and the second evaporator may be considered a low pressure evaporator.

Furthermore, the first vapor compression circuit 102 may be considered a high pressure vapor compression circuit because the first vapor compression circuit 102 directs working fluid from the first evaporator 110 (e.g., high pressure evaporator) to the first condenser 104 (e.g., high pressure condenser). Thus, the first compressor 124 may be considered a high pressure compressor that discharges compressed working fluid to the first condenser 104 at a relatively high pressure. The second vapor compression circuit 107 may be considered a low pressure vapor compression circuit because the second vapor compression circuit 107 directs working fluid from the second evaporator 114 (e.g., low pressure evaporator) to the second condenser 106 (e.g., low pressure condenser). Thus, the second compressor 126 may be considered a low pressure compressor that discharges compressed working fluid to the second condenser 106 at a pressure less than the working fluid discharged from the first compressor 124. Additionally, the shared vapor compression circuit 105 may be considered a mixed line because working fluid from both the first vapor compression circuit 102 (e.g., high pressure vapor compression circuit) and the second vapor compression circuit 107 (e.g., low pressure vapor compression circuit) combine to flow through the shared vapor compression circuit 105.

Generally, decreasing the pressure of the working fluid may decrease a temperature of the working fluid and thus increase the cooling capacity of the working fluid within the evaporators 110, 114 (e.g., to absorb heat from the conditioning fluid). However, decreasing the pressure of the working fluid may also vaporize a portion of the working fluid and may reduce a performance of the HVAC&R system 100, as set forth above. Moreover, a portion of the working fluid may vaporize as the working fluid is directed into one of the heat exchangers due to a sudden increase in volume. Further still, some of the working fluid may vaporize when absorbing thermal energy (e.g., from the conditioning fluid). For example, a portion (e.g., 25%, 50%) of the working fluid in the first evaporator 110 may vaporize after absorbing thermal energy from the conditioning fluid, and a portion (e.g., 90% to substantially 100%) of the working fluid in the second evaporator 114 may vaporize in the second evaporator 114.

The presence of vaporized working fluid entering the first evaporator 110 and/or the second evaporator 114 may decrease an effectiveness or an efficiency of the HVAC&R system 100. For instance, the working fluid vapor may have a lower cooling capacity when compared to working fluid liquid. Thus, the presence of working fluid vapor in the first evaporator 110 and/or the second evaporator 114 (e.g., received from the first evaporator 110) may limit an overall cooling capacity of the working fluid to absorb thermal energy from the conditioning fluid. To reduce the presence of working fluid vapor in the first evaporator 110 and increase the cooling capacity of the working fluid generally, working fluid vapor may be removed from first evaporator 110 while the HVAC&R system 100 is in operation. For example, the first evaporator 110 may act as an economizer that separates the working fluid liquid from the working fluid vapor. In some embodiments, the first compressor 124 may force or draw at least a portion of the working fluid vapor from the first evaporator 110 into the first vapor compression circuit 102, in which the working fluid vapor is compressed and directed toward the first condenser 104. The working fluid liquid may be directed from the first evaporator 110 to the second evaporator 114 via the second vapor compression circuit 107. Thus, the first compressor 124 may enable the first and second evaporators 110, 114 to contain a greater amount of working fluid liquid, thereby increasing an efficiency or effectiveness of the first and second evaporators 110, 114 to cool the conditioning fluid. Similarly, the second compressor 126 may force or draw at least a portion of the working fluid vapor within the second evaporator 114 (e.g., formed as a result of absorption of thermal energy from the conditioning fluid) to pressurize and direct the working fluid toward the second condenser 106.

In some embodiments, the HVAC&R system 100 may additionally include an economizer system 136, which may include a flash tank 134 that is similar to the intermediate vessel 70 described above, disposed between the second condenser 106 and the first evaporator 110. For example, the economizer 134 may be configured to receive the working fluid from the second condenser 106. A first valve 138 may be disposed along the shared vapor compression circuit 105 and may be configured to expand the working fluid flowing from the second condenser 106 to the economizer 134. The flash tank 134 may separate a mixture of working fluid liquid and working fluid vapor received from the second condenser 106. The working fluid liquid may be directed from the economizer system 136 toward the first evaporator 110. In some embodiments, a second valve 140 may be configured to expand the working fluid liquid flowing from the flash tank 134 to the first evaporator 110. In this manner, the working fluid flowing from the economizer system 136 to the first evaporator 110 may be at a lower temperature than the working fluid flowing from the second condenser 106 to the first evaporator 110 via the second expansion valve 130. Thus, the economizer system 136 may decrease an overall temperature of the working fluid entering the first evaporator 110, which may enable the working fluid to absorb a greater amount of thermal energy from the conditioning fluid, thereby increasing an efficiency of the first evaporator 110. Moreover, the economizer 136 may include a third compressor 142 configured to force or draw the working fluid vapor from the flash tank 134. The compressor 142 may pressurize the working fluid vapor and direct the pressurized working fluid vapor to the second vapor compression circuit 107 and toward the second condenser 106.

In some embodiments, the second expansion valve 130 may be closed, or the shared vapor compression circuit 105 may not be included, such that substantially all of the working fluid in the second condenser 106 flows to the flash tank 134. In other words, the working fluid is discharged from the second condenser 106 and directed toward the flash tank 134. The working fluid in the flash tank 134 may separate into a liquid portion and a vapor portion, where the vapor portion may be drawn from the flash tank 134 via the third compressor 142 and the liquid portion flows toward the first evaporator 110. In an additional or an alternative embodiment, the third compressor 142 may be removed, and the second compressor 126 may be configured to draw the vapor portion of the working fluid directly from the flash tank 134. For example, the second compressor 126 may be a multistage (e.g., two-stage) compressor having an economizer port. The economizer port may draw the vapor portion of the working fluid from the flash tank 134 into the second compressor 126, where the vapor portion of the working fluid is combined with the working fluid received from the second evaporator 114. The compressor 126 may then pressurize the combined working fluid and direct the combined working fluid to the second condenser 106.

Figure 6:
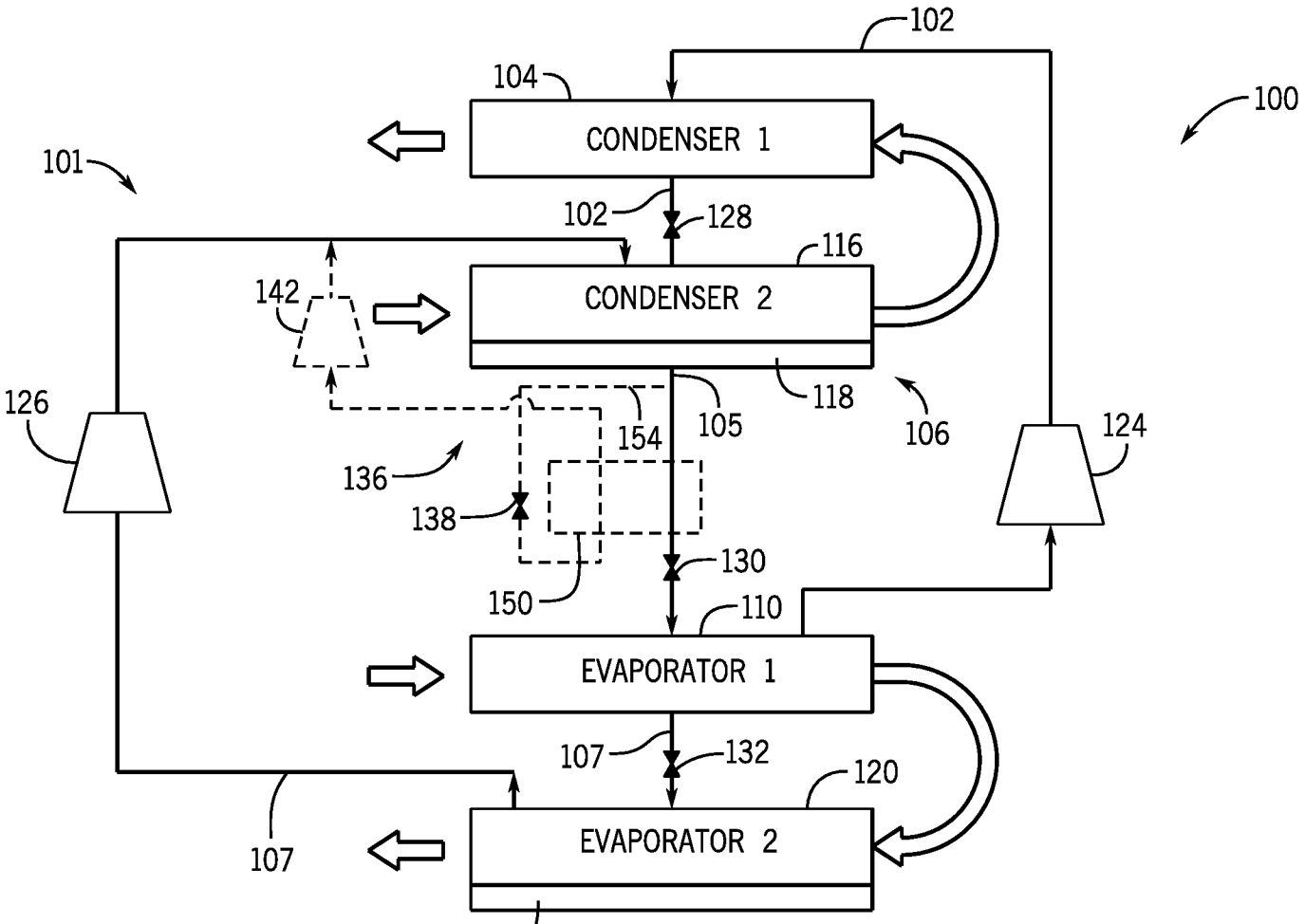
FIG. 6 is a schematic view of another embodiment of the HVAC&R system using an additional heat exchanger in an economizer system, in accordance with an aspect of the present disclosure.

FIG. 6 is a schematic view of an embodiment of the HVAC&R system 100 using an additional heat exchanger 150 (e.g., a shell and tube heat exchanger, a brazed plate heat exchanger) in the economizer system 136 in addition to or in lieu of the flash tank 134. The additional heat exchanger 150 may receive working fluid liquid from the second condenser 106 and may further cool the working fluid liquid directed to the first evaporator 110. For example, the shared vapor compression circuit 105 may direct the working fluid liquid through the additional heat exchanger 150. A portion 154 (e.g., a first portion) of the working fluid liquid may be directed from the shared vapor compression circuit 105 through the first valve 138, which expands and cools the portion 154 of the working fluid liquid. The first valve 138 then directs the cooled portion 154 of the working fluid liquid through the additional heat exchanger 150, which then may then place the cooled portion 154 of the working fluid liquid in a heat exchange relationship with a remaining portion (e.g., a second portion) of the working fluid liquid directed through the additional heat exchanger 150 to further cool the remaining portion of the working fluid liquid. In the illustrated embodiment, the portion 154 of the working fluid liquid and the remaining portion of the working fluid liquid are directed through the additional heat exchanger 150 in a parallel counterflow arrangement. In additional or alternative embodiments, the portion 154 of the working fluid liquid and the remaining portion of the working fluid liquid may be directed through the additional heat exchanger 150 in a parallel series flow arrangement or another suitable flow arrangement. After exchanging heat with the remaining portion of the working fluid, the portion 154 of the working fluid liquid may be drawn into the third compressor 142, and the remaining portion of the working fluid liquid flows toward the first evaporator 110. In further embodiments, the additional heat exchanger 150 may not be utilized to cool the working fluid liquid, such that the first valve 138 may close and/or the working fluid liquid may bypass the additional heat exchanger 150.

FIG. 7 is a cross-section of an embodiment of a shell 200 of a heat exchanger (e.g., the first evaporator 110 and/or the second evaporator 114) that may be included in the HVAC&R system 100. As illustrated in FIG. 7, the shell 200 may have a substantially circular cross-section, though in other embodiments, the shell 200 may have any suitable cross-sectional shape. In the illustrated embodiment, the shell 200 may include the first evaporator 110 and the second evaporator 114 positioned adjacent to one another relative to a lateral axis 202, though the shell 200 may alternatively include the first evaporator 110 and the second evaporator 114 positioned in another configuration. Additionally, another shell may include a different set of heat exchangers, such as the first condenser 104 and the second condenser 106. The first evaporator 110 may include a first tube bundle 204 configured to receive the conditioning fluid directed through the first evaporator 110. The second evaporator 114 may include a second tube bundle 206 configured to receive the conditioning fluid directed through the second evaporator 114. For example, the conditioning fluid may be directed through the first evaporator 110 (e.g., in a first flow direction along a longitudinal axis 212) via the first tube bundle 204 and then the conditioning fluid may flow through the second evaporator 114 (e.g., in a second flow direction along the longitudinal axis 212 opposite the first flow direction).

Furthermore, the shared vapor compression circuit 105 may direct working fluid into the first evaporator 110 via a first inlet 222 to place the working fluid in thermal communication with the conditioning fluid directed through the first tube bundle 204 so as to absorb thermal energy from the conditioning fluid. As a result of absorbing thermal energy, a portion of the working fluid in the first evaporator 110 may vaporize, while a remainder of the working fluid remains in a liquid state. In some cases, the working fluid vapor and the working fluid liquid may separate in the first evaporator 110, such that the working fluid vapor is directed out of the first evaporator 110 via a first outlet 224 and toward the first condenser 104 (e.g., via the first compressor 124). The working fluid liquid may be directed out of the first evaporator 110 via a second outlet 226 that is fluidly coupled to the first evaporator 110 (e.g., via the second vapor compression circuit 107). The second vapor compression circuit 107 may then direct the working fluid liquid into the second evaporator 114 via a second inlet 228. In the second evaporator 114, the working fluid liquid may further be placed in thermal communication with the conditioning fluid, and a portion of the working fluid liquid may evaporate as a result of absorbing heat from the conditioning fluid. The working fluid may separate in the second evaporator 114 into the vapor section 120 containing the working fluid vapor and the flooded section 122 containing the working fluid liquid. As an example, the working fluid liquid may be denser than the working fluid vapor such that the flooded section 122 is located below the vapor section 120 relative to the vertical axis 210. The working fluid vapor may be directed out of the second evaporator 114 via a third outlet 230 and toward the second condenser 106. Further, the working fluid liquid may remain in the second evaporator 114 to absorb heat from conditioning fluid entering the second evaporator 114.

In some embodiments, the shell 200 may include a wall 236 that fluidly separates the first evaporator 110 from the second evaporator 114. That is, the wall 236 separates the working fluid flowing through the first evaporator 110 and the working fluid flowing through the second evaporator 114. In alternate embodiments, the first evaporator 110 and the second evaporator 114 may be separated by a gap or space instead of the wall 236.

FIG. 8 is a schematic view of another embodiment of the HVAC&R system 100 having multiple vapor compression circuits. As illustrated in FIG. 8, the HVAC&R system 100 includes the first condenser 104 (e.g., high pressure condenser), the second condenser 106 (e.g., low pressure condenser), the first evaporator 110 (e.g., high pressure evaporator), and the second evaporator 114 (e.g., low pressure evaporator). The conduit system 101 of the HVAC&R system 100 may include a first vapor compression circuit 250 (e.g., a high pressure vapor compression circuit) configured to direct working fluid from the second evaporator 114 to the first condenser 104 and then to the second condenser 106. The conduit system 101 may also include a shared vapor compression circuit 252 configured to direct combined working fluid within the second condenser 106 toward the first evaporator 110. Further a second vapor compression circuit 254 (e.g., a low pressure vapor compression circuit) is configured to direct working fluid from the first evaporator 110 to the second condenser 106. The first vapor compression circuit 250 may include a first compressor 260, and the second vapor compression circuit 254 may include a second compressor 258. Additionally, in some embodiments, the first vapor compression circuit 250 may be configured to direct working fluid from the first evaporator 110 to the second evaporator 114. In some embodiments, the HVAC&R system 100 may include the economizer system 136, as described above with respect to the embodiment of FIG. 5.

The first evaporator 110 of the embodiment of the HVAC&R system 100 of FIG. 8 may also act as an economizer, in which working fluid liquid may be separated from working fluid vapor in the first evaporator 110. For example, working fluid liquid may be directed from the first evaporator 110 to the second evaporator 114. Moreover, in the HVAC&R system 100 of FIG. 8, working fluid vapor formed within, or otherwise present in, the first evaporator 110 may be directed toward the second condenser 106, rather than the first condenser 104 as described above with reference to FIG. 5. By way of example, the second compressor 258 may be fluidly coupled to the first evaporator 110 via the second vapor compression circuit 254, where the first second compressor 258 is configured to force or draw the working fluid vapor from the first evaporator 110 toward the second condenser 106. In the second condenser 106, the working fluid is placed in thermal communication with the cooling fluid to reduce a temperature of the working fluid.

In the illustrated embodiment of FIG. 8, working fluid from the second evaporator 114 may be directed toward the first condenser 104. For example, the first compressor 260 may be fluidly coupled to the second evaporator 114 via the first vapor compression circuit 250, where the second first compressor 260 is configured to force or draw working fluid from the second evaporator 114 into the first vapor compression circuit 250. The working fluid is then placed in thermal communication with cooling fluid directed through the first condenser 104. The first vapor compression circuit 250 may be considered a high pressure vapor compression circuit that includes a pressure of the working fluid that is greater than a pressure of the working fluid within the second vapor compression circuit 254. As such, the second vapor compression circuit 254 may be considered a low pressure vapor compression circuit. Furthermore, the shared vapor compression circuit 252 may be considered a mixed vapor compression circuit that combines working fluid from the high pressure vapor compression circuit and the lower pressure vapor compression circuit.

FIG. 9 is a schematic view of another embodiment of the HVAC&R system 100 having multiple vapor compression circuits and having a bypass conduit assembly 280 that enables the multiple vapor compression circuit to operate independently of one another and/or without mixing working fluid from each of the multiple vapor compression circuits. For example, the bypass conduit assembly 280 may include a bypass valve 282 to enable working fluid to flow from the first condenser 104 to the second evaporator 114 (e.g., without flowing through the second condenser 106 and/or the first evaporator 110). Therefore, the working fluid flowing through the bypass conduit assembly 280 bypasses the second condenser 106 and the first evaporator 110, such that working fluid from the first vapor compression circuit 250 is not mixed with working fluid from the second vapor compression circuit 254 in the second condenser 106.

In some embodiments, the HVAC&R system 100 may be configured to operate in two modes based on feedback indicative of operating conditions of the HVAC&R system 100. For instance, a position of the bypass valve 282 may be adjusted based on the feedback to transition between a first operating mode and a second operating mode. In the first operating mode, the bypass valve 282 may be adjusted to a closed position, and the first expansion valve 128, the second expansion valve 130, and the third expansion valve 132 may be adjusted to an open position to enable working fluid to flow from the first condenser 104 and through the second condenser 106 and the first evaporator 110, as previously described in FIG. 8. In the second operating mode, the bypass valve 282 may be adjusted to an open position to enable working fluid to flow from the first condenser 104 toward the second evaporator 114, and the first expansion valve 128, the second expansion valve 130, and/or the third expansion valve 132 may be adjusted to a closed position to block working fluid from flowing from the first condenser 104 to the second condenser 106 and/or the first evaporator 110. In some embodiments, operation of the second condenser 106 and the first evaporator 110 may be suspended in the second operating mode to reduce energy consumption of the HVAC&R system 100. In other embodiments, operation of the second condenser 106 and the first evaporator 110 may be active, such that the first vapor compression circuit 250 and the second vapor compression circuit 254 operate independent of one another (e.g., working fluid from the first vapor compression circuit 250 does not mix with working fluid from the vapor compression circuit 254).

The HVAC&R system 100 may further include a control system 284 configured to control operation of the HVAC&R system 100 by adjusting the bypass valve 282, the first expansion valve 128, the second expansion valve 130, and/or the third expansion valve 132. For example, the control system 284 may include a memory 286 and a processor 288. The memory 286 may be a mass storage device, a flash memory device, a removable memory, or any other non-transitory computer-readable medium that includes instructions for controlling the HVAC&R system 100. The memory 286 may also include volatile memory, such as randomly accessible memory (RAM) and/or non-volatile memory, such as hard disc memory, flash memory, and/or other suitable memory formats. The processor 288 may execute the instructions stored in the memory 286, such as instructions to adjust the position of the bypass valve 282, the first expansion valve 128, the second expansion valve 130, and/or the third expansion valve 132 to control a flow of the working fluid between components of the HVAC&R system 100.

For example, the control system 284 may be configured to operate the HVAC&R system 100 in the first operating mode by opening the first expansion valve 128, opening the second expansion valve 130, opening the third expansion valve 132, and closing the bypass valve 282. The control system 284 may also be configured to operate the HVAC&R system 100 in the second operating mode by closing the first expansion valve 128, closing the second expansion valve 130, closing the third expansion valve 132, and/or opening the bypass valve 282. In some embodiments, the control system 284 may be configured to operate the HVAC&R system 100 based on user input received from a user interface that is communicatively coupled to the control system 284. In other embodiments, the control system 284 may be configured to transition between the first operating mode and the second operating mode based on feedback received by the control system 284 that is indicative of one or more operating parameters of the HVAC&R system 100.

By way of example, the control system 284 may be communicatively coupled to a sensor 290 configured to determine an operating parameter of the HVAC&R system 100. The operating parameter may be a target temperature of the conditioning fluid, a current temperature of the conditioning fluid, a temperature of the working fluid, a pressure of the working fluid, a temperature of the cooling fluid, a target load demand of the HVAC&R system 100, another suitable operating parameter, or any combination thereof. In certain embodiments, the control system 284 may compare the feedback indicative of the operating parameter with a threshold value, and the control system 284 may adjust operation of the HVAC&R system 100 based on the comparison. For instance, the control system 284 may operate the HVAC&R system 100 in the first operating mode upon receiving feedback indicative of a load demand of the HVAC&R system falling below a threshold value. In other words, the control system 284 operates the HVAC&R system 100 in the first operating mode when a target temperature of the conditioning fluid may be achieved using a single vapor compression circuit (e.g., a single evaporator may reduce a temperature of the conditioning fluid to the target temperature). In another example, the input may be a user input indicating that the HVAC&R system 100 should operate in the first operating mode or the second operating mode. In some cases, the user input may override a current operating mode of the HVAC&R system 100 that is determined based on the feedback indicative of the operating parameter of the HVAC&R system 100. For example, the user input may suspend operation of a component of the HVAC&R system 100 (e.g., the second condenser 106), such that maintenance may be performed on the component. Thus, operating the HVAC&R system 100 in the first operating mode enables the HVAC&R system 100 to continue to condition the conditioning fluid (e.g., using the first vapor compression circuit 250) while maintenance is performed on inactive components (e.g., components of the second vapor compression circuit 254).

FIG. 10 is a block diagram illustrating an embodiment of a method 320 for adjusting operation of the HVAC&R system 100 (e.g., between the first operating mode and the second operating mode). In certain embodiments, the method 320 may be performed by one or more controllers, such as the control system 284. This disclosure primarily discusses the method 320 as applied to the HVAC&R system 100 of FIG. 9, but a similar method or process may be performed in embodiments of the HVAC&R system 100 having a different arrangement or configuration. Furthermore, steps may be performed in addition to the steps described in the method 320, or certain steps of the depicted method 320 may be modified, removed, and/or performed in a different order than shown in FIG. 10.

At block 322, the control system 284 may receive feedback indicating that the HVAC&R system 100 should operate in the first operating mode, which may enable the first vapor compression circuit 250 to operate independently of the second vapor compression circuit 254 (e.g., working fluid from the first vapor compression circuit 250 does not mix with working fluid from the second vapor compression circuit 254). The feedback may include feedback indicative of an operating parameter transmitted by the sensor 290 (e.g., a relatively low operating load) that indicates that operation of a single vapor compression circuit is sufficient for achieving a target temperature of the conditioning fluid. In some embodiments, the feedback may include a user input indicating that the HVAC&R system 100 should operate in the first operating mode.

At block 324, the control system 284 adjusts operation of components of the HVAC&R system 100 to operate in the first operating mode. As an example, the control system 284 may close the first expansion valve 128, close the second expansion valve 130, close the third expansion valve 132, and open the bypass valve 282. In some embodiments, the control system 284 may also suspend or disable operation of certain components (e.g., the second condenser 106, the first evaporator 110) that may not be used while the HVAC&R system 100 is operating in the first operating mode.

At block 326, the control system 284 may receive feedback indicating that the HVAC&R system 100 should operate in the second operating mode (e.g., directing working fluid through the first vapor compression circuit 250, the shared vapor compression circuit 252, and the second vapor compression circuit 254). As described herein, the feedback may include an operating parameter transmitted by the sensor 290 indicative of a condition (e.g., a relatively high operating load) in which operation of the both the first vapor compression circuit 250 and the second vapor compression circuit 254 is utilized to achieve a target operating load. Additionally or alternatively, the feedback may be a user input, such as transmitted from a user interface, indicating that the HVAC&R system 100 should operate in the second operating mode.

At block 328, the control system 284 adjusts one or more components of the HVAC&R system 100 to operate in the second operating mode. For example, the control system 284 may open the first expansion valve 128, open the second expansion valve 130, open the third expansion valve 132, and close the bypass valve 282. Additionally, the control system 284 may enable operation of the second condenser 106, the first evaporator 110, the second compressor 258, and other suitable components to operate the HVAC&R system 100 in the second operating mode.

Embodiments of the present disclosure are directed to an HVAC&R system having multiple vapor compression circuits. For example, the HVAC&R system may circulate a working fluid through a first vapor compression circuit having a first condenser, a shared vapor compression circuit having a second condenser and/or a first evaporator, and/or a second vapor compression circuit having a second evaporator. In each of the condensers, the working fluid may be placed in thermal communication with a cooling fluid configured to absorb thermal energy from the working fluid. In each of the evaporators, the working fluid may be placed in thermal communication with a conditioning fluid, where the working fluid is configured to absorb heat from the conditioning fluid. In the first evaporator, the working fluid may absorb a certain amount of heat that transforms at least a portion of the working fluid from a liquid state to a vaporous state, and the working fluid liquid and the working fluid vapor may be separated in the first evaporator. The working fluid vapor may be directed from the first evaporator to the first condenser of the first vapor compression circuit. The working fluid liquid may be directed from the first evaporator to the second evaporator, in which the working fluid may absorb an additional amount of heat that transforms an additional portion of the working fluid from the liquid state to the vaporous state. The working fluid vapor of the additional portion of the working fluid may be directed from the second evaporator to the second condenser of the second vapor compression circuit. By directing working fluid vapor out of the first evaporator, the second evaporator may receive primarily working fluid liquid, thereby increasing a cooling capacity of the working fluid. Thus, a performance of the HVAC&R system to remove heat from the conditioning fluid may be improved. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, air conditioning, and/or refrigeration (HVAC&R) system, comprising:

a first vapor compression flow path comprising a first condenser configured to place a working fluid in a heat exchange relationship with a cooling fluid;

a second vapor compression flow path comprising a first evaporator configured to place the working fluid in a heat exchange relationship with a conditioning fluid;

a shared vapor compression flow path comprising:

the first evaporator; and a second condenser of the second vapor compression flow path, wherein the second condenser is configured to place the working fluid in a heat exchange relationship with the cooling fluid, wherein the first vapor compression flow path comprises a second evaporator configured to place the working fluid in a heat exchange relationship with the conditioning fluid, the first vapor compression flow path is configured to direct working fluid vapor from the second evaporator to the first condenser, the first vapor compression flow path is configured to direct working fluid liquid from the first evaporator to the second evaporator, the first vapor compression flow path comprises a valve disposed between the first evaporator and the second evaporator, the valve is configured to open and close to control a flow of working fluid liquid from the first evaporator to the second evaporator, the first vapor compression flow path is a high pressure vapor compression flow path, and the second vapor compression flow path is a low pressure vapor compression flow path, such that the first vapor compression flow path is configured to operate at a first working fluid pressure greater than a second working fluid pressure of the second vapor compression flow path; and a bypass conduit system configured to selectively direct a flow of working fluid from the first condenser to the second evaporator of the first vapor compression flow path, such that the flow of working fluid bypasses the second condenser and the first evaporator of the second vapor compression flow path.

2. The HVAC&R system of claim 1, wherein the first vapor compression flow path comprises a compressor configured to direct working fluid vapor from the second evaporator to the first condenser of the first vapor compression flow path.

3. The HVAC&R system of claim 1, wherein the second vapor compression flow path comprises a compressor configured to direct working fluid vapor from the first evaporator to the second condenser of the shared vapor compression flow path.

4. The HVAC&R system of claim 1, wherein the first evaporator and the second evaporator are disposed in a single shell, and wherein the single shell comprises a wall configured to fluidly separate the first evaporator and the second evaporator.

5. The HVAC&R system of claim 1, wherein the shared vapor compression flow path is configured to direct working fluid from the second condenser to the first evaporator.

6. The HVAC&R system of claim 5, comprising an economizer disposed along the shared vapor compression flow path, wherein the economizer is configured to receive at least a portion of the working fluid from the second condenser.

7. The HVAC&R system of claim 6, wherein the first evaporator is configured to receive at least the portion of the working fluid from the economizer.

8. A heating, ventilation, air conditioning, and/or refrigeration (HVAC&R) system, comprising:

a first vapor compression flow path comprising a first condenser configured to place a first portion of a working fluid in thermal communication with a cooling fluid, and a first compressor configured to direct the first portion of the working fluid to the first condenser;

a second vapor compression flow path comprising a second compressor configured to direct a second portion of the working fluid from a first evaporator to a second condenser;

a shared vapor compression flow path comprising the second condenser and the first evaporator, wherein the second condenser is configured to receive the first portion of the working fluid from the first condenser of the first vapor compression flow path and receive the second portion of the working fluid from the first evaporator, wherein the shared vapor compression flow path is configured to direct the first portion of the working fluid and the second portion of the working fluid from the second condenser to the first evaporator, the shared vapor compression flow path comprises a first valve disposed between the second condenser and the first evaporator, and the first valve is configured to open and close to control a combined flow of the first portion of the working fluid and the second portion of the working fluid from the second condenser to the first evaporator, wherein the first vapor compression flow path comprises a second evaporator configured to place the first portion of the working fluid in thermal communication with a conditioning fluid, the first vapor compression flow path comprises a second valve disposed between the first evaporator and the second evaporator, the second valve is configured to open and close to control a flow of the first portion of the working fluid from the first evaporator to the second evaporator, the first vapor compression flow path comprises a third valve disposed between the first condenser and the second condenser, and the third valve is configured to open and close to control a flow of the first portion of the working fluid from the first condenser to the second condenser;

a bypass conduit system configured to selectively direct the first portion of the working fluid from the first condenser to the second evaporator, such that the first portion of the working fluid bypasses the second condenser and the first evaporator; and a controller configured to control operation of the bypass conduit system and to adjust respective positions of the second valve and the third valve to independently operate the first vapor compression flow path and the second vapor compression flow path.

9. The HVAC&R system of claim 8, wherein the first vapor compression flow path is a high pressure vapor compression flow path and the second vapor compression flow path is a low pressure vapor compression flow path.

10. The HVAC&R system of claim 8, wherein the shared vapor compression flow path comprises an economizer, and wherein the economizer is configured to receive the first portion of the working fluid and the second portion of the working fluid from the second condenser.

11. The HVAC&R system of claim 10, wherein the shared vapor compression flow path comprises a compressor configured to direct a third portion of the working fluid from the economizer to the second condenser, and wherein the first evaporator is configured to receive a fourth portion of the working fluid from the economizer.

12. The HVAC&R system of claim 8, wherein the second evaporator is configured to receive the first portion of the working fluid from the first evaporator.

13. The HVAC&R system of claim 8, wherein the bypass conduit system comprises a bypass valve configured to open and close to control flow of the first portion of the working fluid from the first condenser to the second evaporator, and the controller is configured to adjust the second valve and the third valve to respective closed positions and adjust the bypass valve to an open position to operate the first vapor compression flow path during suspended operation of the second vapor compression flow path.

14. A heating, ventilation, air conditioning, and/or refrigeration (HVAC&R) system, comprising:

a first vapor compression flow path comprising a first condenser configured to place a first portion of a working fluid in thermal communication with a cooling fluid and a first compressor configured to direct the first portion of the working fluid to the first condenser;

a second vapor compression flow path comprising a second compressor configured to direct a second portion of the working fluid from a first evaporator to a second condenser;

a shared vapor compression flow path comprising:

the second condenser, wherein the second condenser is configured to place the first portion of the working fluid and the second portion of the working fluid in thermal communication with the cooling fluid; and the first evaporator, wherein the first evaporator is configured to place the first portion of the working fluid and the second portion of the working fluid in thermal communication with a conditioning fluid, wherein the shared vapor compression flow path is configured to direct the first portion of the working fluid and the second portion of the working fluid from the second condenser to the first evaporator; and a bypass conduit system configured to selectively direct the first portion of the working fluid from the first condenser to a second evaporator of the first vapor compression flow path, such that the first portion of the working fluid bypasses the second condenser and the first evaporator.

15. The HVAC&R system of claim 14, wherein the bypass conduit system comprises a valve having a first position and a second position, wherein the valve is configured to enable the first portion of the working fluid to flow through the bypass conduit system in the first position, and the valve is configured to block the first portion of the working fluid from flowing through the bypass conduit system in the second position.

16. The HVAC&R system of claim 15, wherein the valve is a first valve, and the HVAC&R system comprises a second valve having a third position and a fourth position, wherein the second valve is configured to enable the first portion of the working fluid to flow from the first condenser to the second condenser in the third position, and the second valve is configured to block the first portion of the working fluid from flowing from the first condenser to the second condenser in the fourth position.

17. The HVAC&R system of claim 16, comprising a controller communicatively coupled to the first valve and the second valve, wherein the controller is configured to adjust the first valve between the first position and the second position and to adjust the second valve between the third position and the fourth position based on feedback indicative of an operating parameter of the HVAC&R system.

18. The HVAC&R system of claim 17, wherein the controller is configured to adjust the first valve and the second valve to operate the HVAC&R system in a first operating mode and a second operating mode, wherein the first valve is in the first position and the second valve is in the fourth position in the first operating mode of the HVAC&R system, and the first valve is in the second position and the second valve is in the third position in the second operating mode of the HVAC&R system.

19. The HVAC&R system of claim 18, wherein the controller is configured to suspend operation of the second compressor in the first operating mode.

20. The HVAC&R system of claim 18, wherein the controller is configured to operate the HVAC&R system in the first operating mode and the second operating mode based on the operating parameter, wherein the operating parameter comprises a target temperature of the conditioning fluid, a current temperature of the conditioning fluid, a temperature of the working fluid, a pressure of the working fluid, a temperature of the cooling fluid, a target load demand, or any combination thereof.

* * * * *